United States Patent [19]

Rochester

[11] Patent Number: 4,822,308

[45] Date of Patent: Apr. 18, 1989

[54] MARINE STEERING AND PROPULSION SYSTEM

[76] Inventor: Willard G. Rochester, 12062 Normandy Blvd., Jacksonville, Fla. 32221

[21] Appl. No.: 98,912

[22] Filed: Sep. 21, 1987

[51] Int. Cl.[4] ..... B63H 1/16

[52] U.S. Cl. ..... 440/66; 415/122 A; 416/189; 416/191; 440/67

[58] Field of Search ..... 440/66, 67, 48, 43; 415/122 A; 416/174, 179, 189 R, 189 A, 189 B, 191; 74/447

[56] References Cited

U.S. PATENT DOCUMENTS

| | | | |
|---|---|---|---|
| 899,359 | 9/1908 | Wadagaki | 440/68 |
| 3,361,107 | 1/1968 | Weber | 440/67 |
| 3,441,088 | 4/1969 | Levy | 440/48 X |
| 3,487,805 | 1/1970 | Satterthwaite et al. | 440/67 |
| 3,804,553 | 4/1974 | Hickey, Jr. | 416/189 R |

FOREIGN PATENT DOCUMENTS

| | | | |
|---|---|---|---|
| 283 | of 1883 | United Kingdom | 440/67 |

*Primary Examiner*—Sherman D. Basinger

[57] ABSTRACT

A propeller enclosed in an open tube and attached to the tube, with the tube being driven by an engine through a ring gear rack on the outside of the tube, a stationary housing concentrically outside the tube and attached to the boat hull, bearings and seals between the housing and the tube to permit the space between the housing and tube to be filled with lubricating oil, and a pivotable rudder located partially inside and partially outisde the aft end of the tube.

9 Claims, 2 Drawing Sheets

MARINE STEERING AND PROPULSION SYSTEM

BACKGROUND OF THE INVENTION

Boats are usually propelled by a propeller attached to a drive shaft extending through the boat hull to an engine inside the boat. In order to have a direct drive from the engine to the propeller the engine is tipped at an angle or the stern angled upwardly below the water level so the propeller and shaft can be reasonably close to horizontal and at the same time be below the lowest part of the hull. In smaller boats there has also been the problem of entangling the propeller in plants growing below the water level. One solution to this problem has been to enclose the propeller in a tube which diverts the plants away from the propeller. The drive for such enclosed propellers has been somewhat complicated and such systems have not become popular. This invention provides an improved system which permits horizontal positioning of the engine, a high speed drive system, and excellent lubrication for the drive.

It is an object of this invention to provide an improved propeller drive system for boats. It is another object of this invention to provide such a system with the drive components totally submerged in lubricant. Still other objects will become apparent from the more detailed description which follows.

BRIEF SUMMARY OF THE INVENTION

This invention relates to a marine steering and propulsion system for a boat wherein a propeller is fixed to and housed inside a cylindrical tube open at both ends and which is peripherally driven through a ring gear rack on the outside of the tube. The inventive features comprise a stationary housing spaced outwardly from the cylindrical tube and affixed to said boat; a ring bearing at each end of the tube and designed to permit the tube to rotate inside of the housing; a seal external to each bearing to prevent water from entering between the housing and the tube; means to maintain a supply of lubricant in the space between said housing and said tube; and a pivotable rudder partially within and partially outside of the housing.

In preferred embodiments the housing is split along a horizontal plane into two portions for ease in assembly and maintenance; a streamlined tapered entranceway is employed to direct the water into the tube; and the engine and drive shaft are positioned parallel to the longitudinal axis of the tube and fitted with a gear train to turn the tube at about a 1:1 ratio with the drive shaft.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
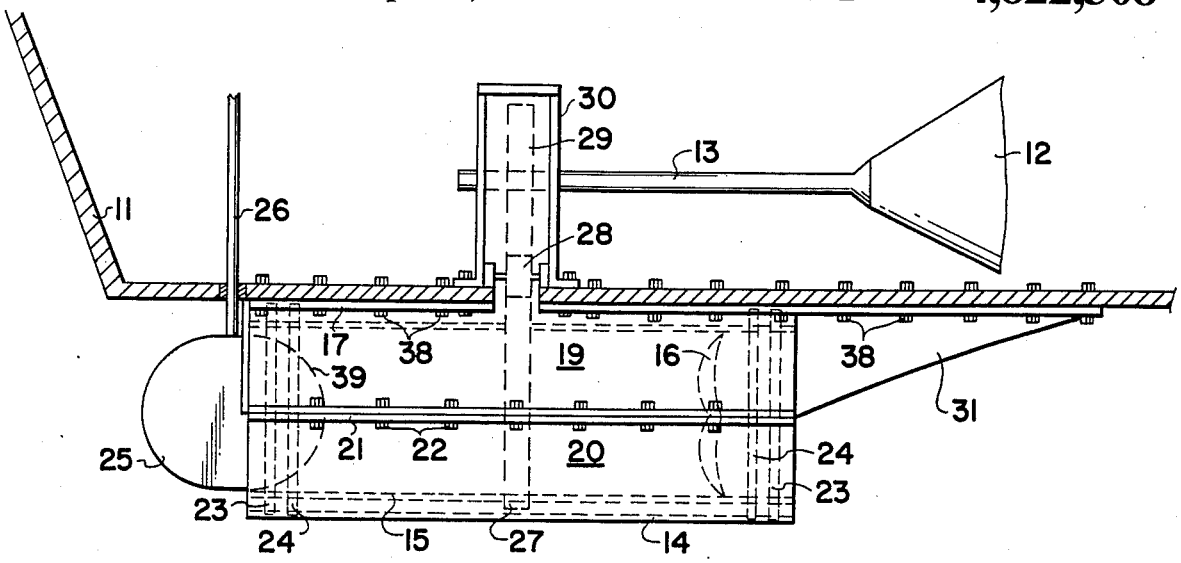
FIG. 1 is a schematic illustration, partially in cross section, of a boat employing the system of this invention.
Figure 2:
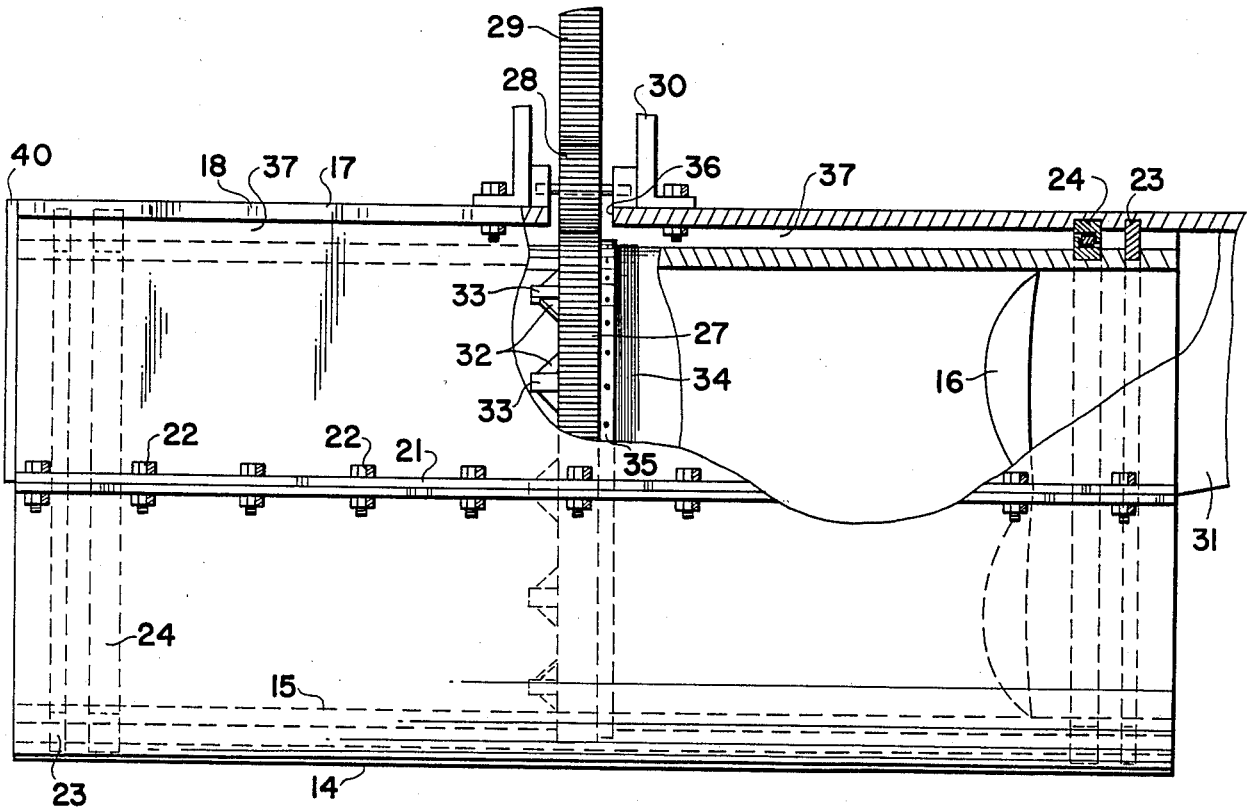
FIG. 2 is a side elevational view of the steering and propulsion system of this invention.
Figure 3:
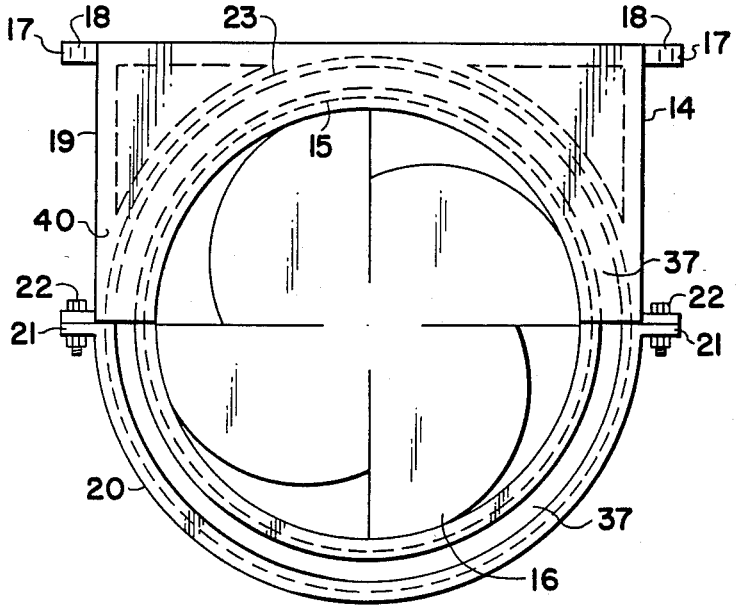
FIG. 3 is a front elevational view of the system of FIG. 2.

The manner in which this invention is used may best be appreciated by reference to FIGS. 1–3.

Under the stern of boat hull 11 is a propeller 16 which is driven by motor 12 through drive shaft 13. Propeller 16 is attached at its tips to a cylindrical propeller tube 15 which is aligned with the longitudinal axis of the boat 11. Tube 15 rotates inside of stationary housing 14 that is affixed to boat hull 11. The driving connection between propeller 16 and motor 12 is through a gear rack 27 around the outside periphery of tube 15, pinion gear 28, and drive gear 29, the latter being keyed to drive shaft 13. Preferably, drive gear 29 and gear rack 27 are of the same size, having a gear ratio of 1:1 so that gear 27 turns at the same speed as gear 29, drive shaft 13 and motor 12.

Propeller tube 16 is encased around its periphery by housing 14 which is stationary and bolted to boat hull 11. Between tube 16 and housing 14 is a small cylindrical space 37 which is intended to be filled with lubricating oil. This space is formed at the ends of tube 16 and housing 14 by liquid ring seals 23 which prevent oil from escaping from space 37, and water from seeping into space 37. Ring bearings 24 join tube 16 to housing 14 so that tube 16 can rotate easily. Any type of bearing is suitable, e.g., ball bearing, roller bearing, or the like.

Around the middle portion of tube 16 is a gear rack attached to the outside of tube 16. Such a rack may be welded to the outside of tube 16 or attached by any other suitable means. A preferred arrangement is shown in FIG. 2. Spaced recesses are formed on one side of gear rack 27 by means of pairs of projections 32 attached to gear rack 27. These recesses 32 are matched with spaced teeth 33 attached to propeller tube 15. When recesses 32 are fitted to teeth 33, gear rack 27 is held fast as a part of tube 15. On the other side of gear rack 27 is a section of external threads 34 on tube 15 and a clamp ring 35 which is screwed onto threads 34 to hold gear rack 27 firmly into contact between teeth 33 and recesses 32. This arrangement holds gear rack 27 tightly on tube 15.

Housing 14 is preferably split into two halves along a horizontal plane through flanges 21. Upper portion 19 is attached to lower portion 20 by a plurality of bolts 22 through flanges 21. Upper portion 19 has a semicylindrical interior facing tube 15 and a rectangular extension which is attached to boat hull 11 by means of bolts 38 through bolt holes 18 in flanges 17. Lower portion 20 is semicylindrical, both outside and inside, and is fastened to upper portion 19 by bolts 22 joining flanges 21. Space 37 between tube 15 and housing 14 is filled with lubricating oil to lubricate bearings 24 and gear rack 27. Above hull 11 housing 30 for gear 29 communicates with space 37 through opening 36. Oil may, therefore, be admitted through the top of housing 30 and filled to the top of housing 30.

In order to provide a smooth entrance for water to go through tube 15, a tapered, smooth, streamlined entranceway 31 is fitted to the forward end of tube 30 so as to direct the water into tube 15 and eliminate any blunt surfaces that would cause flow restrictions. Entranceway 31 extends from hull 11 to the semicircular entrance of upper portion 19.

Rudder 25 is attached to rudder post 26 in a pivotable manner such that turning post 26 causes rudder 25 to turn. It is important in this invention that the forward portion of rudder 25, i.e., substantially all of the portion forward of post 26, is positioned inside of the aft portion of tube 15. Preferably the leading edge 39 of rudder 25, which is inside propeller tube 15, has a diameter about 5% less than the inside diameter of tube 15 so as to form a reasonably close fit and yet allow rudder 25 to turn in any direction. This arrangement provides a better steering effect than to locate all of rudder 25 outside of tube 15, and, of course, it would not be feasible to put rudder 25 completely inside of tube 15.

One of the advantages of this system is that motor 12 and drive shaft 13 can be positioned horizontally and yet have the advantage of a direct drive to the propeller 16. Gear 29 is made substantially identical to gear rack 27 so that the gear ratio may be 1:1. No positioning difficulties are encountered such as those of angling the drive shaft 13 through the boat hull 11. The system is particularly useful for boats which navigate through shallow waterways where weeds and plant life grow in the water, since the system is not likely to result in entanglement of the propeller by such weeds and plant life.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a marine steering and propulsion system for a boat having a propeller inside a cylindrical tube open at both ends and with the tips of said propeller attached to said tube which is peripherally driven through a ring gear rack on the outside of said tube, the improvement which comprises a stationary housing spaced concentrically outwardly from said tube and rigidly affixed to said boat, a ring bearing at each end of said tube adapted to permit said tube to rotate inside of said housing, a seal longitudinally external to each said bearing to prevent water from entering between said housing and said tube, means to maintain a supply of lubricating oil in the space between said housing and said tube; and a pivotable rudder partially within said housing aft of said propeller and partially outside of said housing and aft thereof.

2. The system of claim 1 wherein said housing is separable along a horizontal plane into an upper portion and a lower portion, said upper portion having a semicylindrical interior surface to fit closely adjacent over said tube and having an outer surface with means to affix said housing to the hull of said boat; and said lower portion having a semicylindrical interior surface adapted to be joined to said upper portion to form a closely fitting concentric housing around said tube.

3. The system of claim 1 wherein said housing includes a smoothly tapered entranceway at the forward end of said housing to direct water into said tube.

4. The system of claim 1 wherein said ring gear rack is affixed to said cylindrical tube by means including a plurality of spaced recesses on said gear rack corresponding with a plurality of spaced teeth affixed to said tube and a threaded ring cooperating with exterior threads on said tube to press said gear rack recesses into mesh with said teeth.

5. The system of claim 1 which additionally comprises a pinion gear in mesh with said ring gear rack, and a spur gear in mesh with said pinion gear and said spur gear being driven by a motor on said boat.

6. In a marine steering and propulsion system for a boat in which an engine having a generally horizontal drive shaft is coupled to and drives a propeller encased in and affixed to a generally horizontal open cylindrical tube; the improvement which comprises a ring gear rack affixed to the outside of said cylindrical tube and drivingly engaged with a gear train connected to said drive shaft with a gear ratio of about 1:1 between said drive shaft and said propeller; said cylindrical tube being rotatably encases in a stationary housing attached to said boat with said tube being rotatable while submerged in a pool of lubricating oil contained in said housing, said gear rack also being submerged in said pool; and a rudder partially inside of said housing aft of said propeller and partially outside of said housing.

7. The system of claim 6 wherein said cylindrical tube is concentrically spaced inwardly from said housing and being separated from each other by a pair of ring bearings and a pair of liquid lubricant seals.

8. The system of claim 6 wherein said housing is openable along a central horizontal plane to provide access to said cylindrical tube, said gear rack, said bearings, and said seals.

9. The system of claim 6 which additionally comprises a pivotable rudder having a leading edge inside of said cylindrical tube aft of said propeller and a trailing edge outside of and aft of said tube, said leading edge being generally semicircular with a diameter approximately 95% of the inside diameter of said tube.

* * * * *